US005267403A

United States Patent [19]

Hesner

[11] Patent Number: 5,267,403

[45] Date of Patent: Dec. 7, 1993

[54] MULTIPLE PICTURE-HOLDER

[76] Inventor: Walter Hesner, 66, rue de La Prulay, CH-1217 Meyrin, Switzerland

[21] Appl. No.: 634,203

[22] PCT Filed: Apr. 26, 1990

[86] PCT No.: PCT/CH90/00111

§ 371 Date: Feb. 22, 1991

§ 102(e) Date: Feb. 22, 1991

[87] PCT Pub. No.: WO90/13246

PCT Pub. Date: Nov. 15, 1990

[30] Foreign Application Priority Data

May 9, 1989 [CH] Switzerland ..... 1731/89
Aug. 17, 1989 [CH] Switzerland ..... 2998/89
Mar. 19, 1990 [CH] Switzerland ..... 884/90

[51] Int. Cl.[5] ..... G09F 1/12

[52] U.S. Cl. ..... 40/152; 40/605; 403/294; 220/23.4

[58] Field of Search ..... 40/152, 124, 605, 152.1; 403/286, 294, 341; 220/23.4

[56] References Cited

U.S. PATENT DOCUMENTS 3,339,302 9/1967 Mallory ..... 40/152
3,722,122 3/1973 Sesto ..... 40/152
4,017,989 4/1977 Murray ..... 40/152
4,706,397 11/1987 Hesener ..... 40/152

FOREIGN PATENT DOCUMENTS 0087624 9/1983 European Pat. Off. .

*Primary Examiner*—Kenneth J. Dorner
*Assistant Examiner*—J. Bonifanti
*Attorney, Agent, or Firm*—Keck, Mahin & Cate

[57] ABSTRACT

The multiple picture-holder described has square mounts (K1) of different sizes. Each mount comprises a transparent faceplate (1) and a backplate (2) fastened against it. The faceplate (1) has, printed on it, a mask (3) surrounding a rectangular window (1*a*). The rear side of the backplate (2) is divided into squares (2*c*), the outer of which are designed as click-in attachment fixtures (2*c*') for connecting clips (6). The connecting clips (6) have matching fixtures (6*b*) which engage in the attachment fixtures (2*c*') so that they are held in place. Both the distance between the centre-lines (M) of two adjacent attachment fixtures (2*c*') and the distance between the mount sides and the adjacent centrelines (M) have the same value (X). It has been found that suitable distances (X) are those which permit combinations of mounts (K1) designed for different standard photo sizes, such as 9×13, 10×15, 13×18 and 18×25 cm or 4×6, 5×8 and 8×10 inches, although the latter sizes are not in the same proportions to each other.

22 Claims, 6 Drawing Sheets

Figure 5:
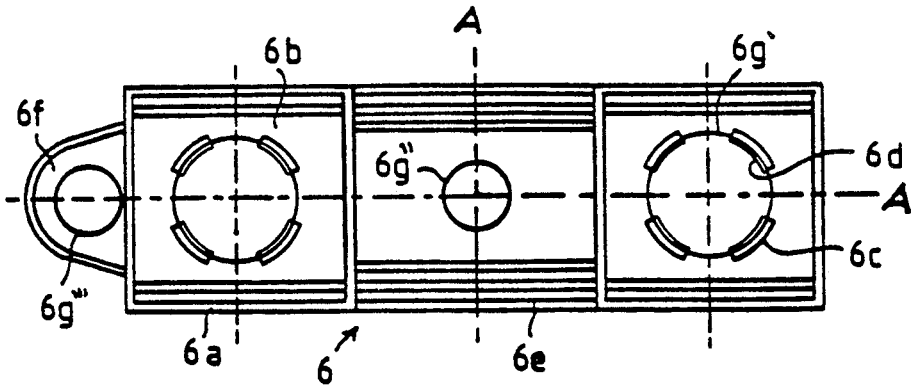

FIG.2
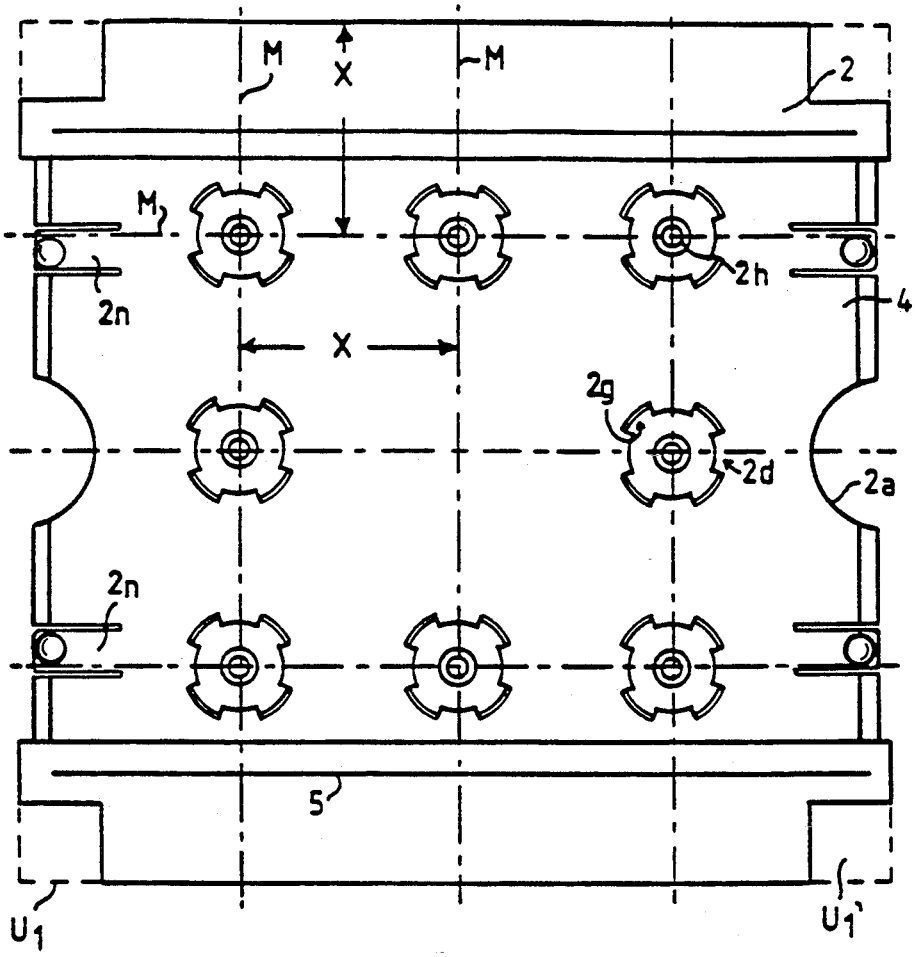
FIG.4
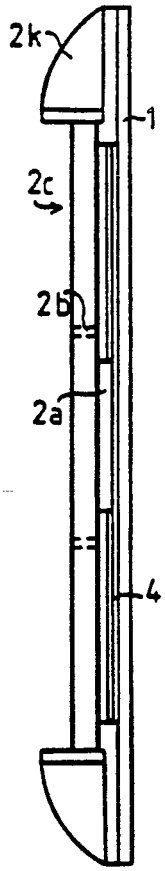
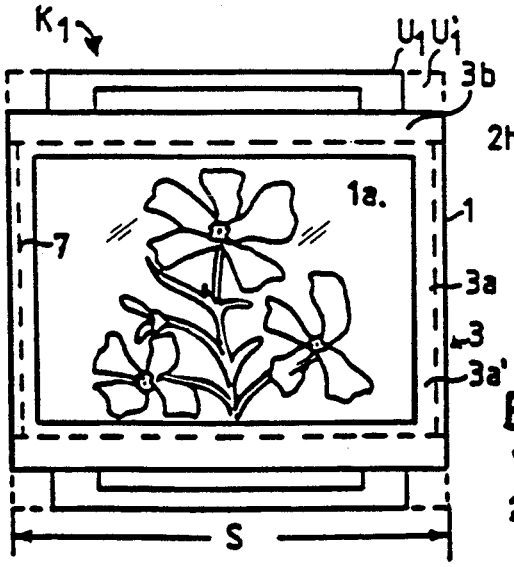
FIG.1
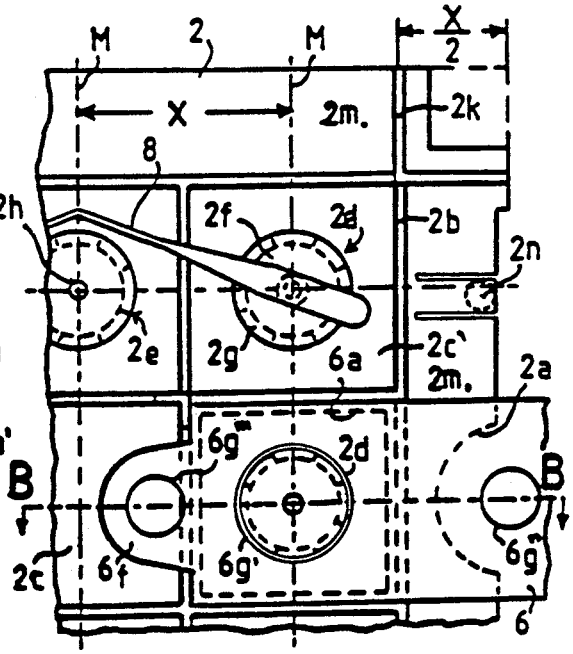
FIG.3

FIG. 14
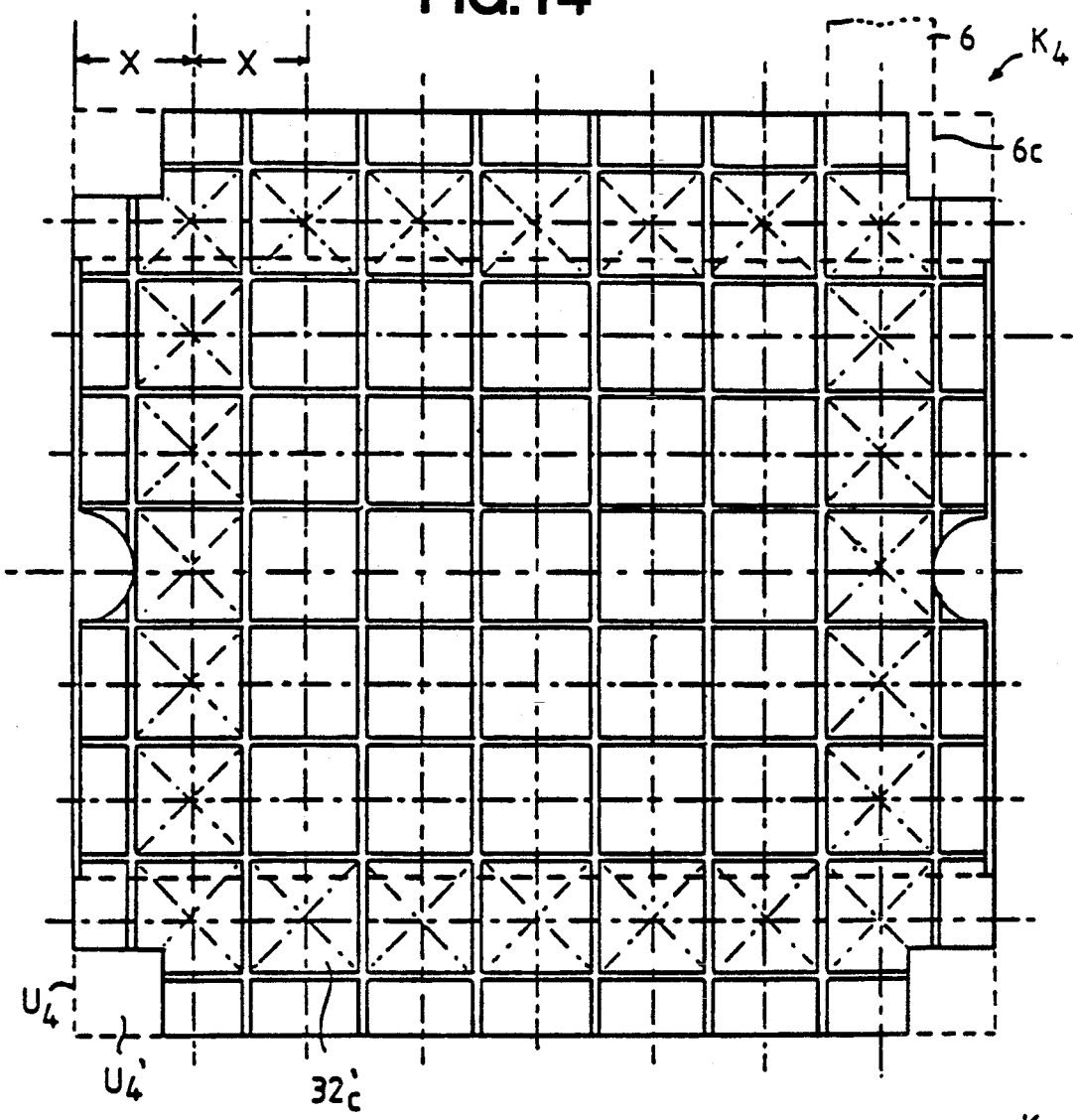
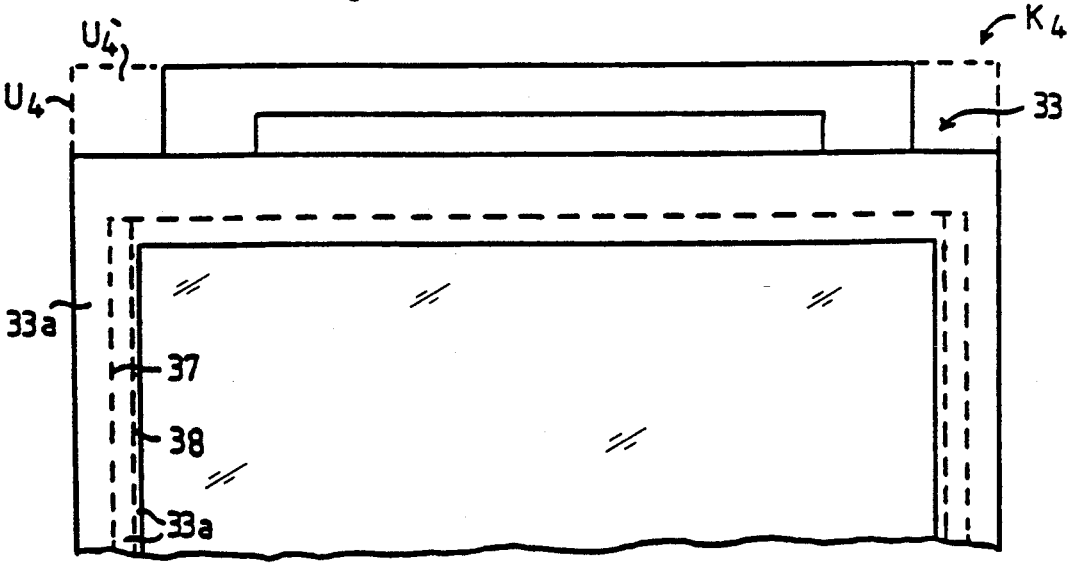
FIG. 15

MULTIPLE PICTURE-HOLDER

FIELD OF THE INVENTION

The invention relates to a multiple picture-holder for photos, prints, etc., consisting of single-frame mounts of square shape, each consisting of a faceplate with a window enclosed by a frame element covering the rims of the inserted pictures, and of a backplate attached to said faceplate in order to secure the pictures, molded to which backplate are a number of click-in attachment fixtures, concealed in a horizontal perspective of the mounts, to receive connecting clips for the mutual attachment of adjacent mounts.

BACKGROUND OF THE INVENTION

A multiple picture-holder of this type is known to the prior art from U.S. Pat. No. 4 706 397. The single-frame mounts can be joined together to form compositions of various geometric shape in two perpendicular directions. Each mount provided with a rectangular window can be adjusted to accommodate a portrait or landscape style photo. Two adjacent mounts in combination will rest in undisplaced position relative to each other, i.e. their corresponding centerlines run along the same axis.

The stimulus to the present invention was provided by a dissatisfaction with the combinations permitted by the system according to the U.S. patent. This led to the problem on which the invention is based, namely to elaborate the mounts with the simplest means possible and in such a way that at least two different mount sizes for different standard photo formats could be combined as variously as possible, i.e. including with displaced centerlines. In the past this has seemed impossible, because, for example, the lengths: 13–15–18–25 cm of standard photo formats 9×13, 10×15, 13×18, 18×25 cm had divergent ratios: 0.86–0.83–0.72 and the corresponding photo widths: 9–10–13–18 cm represent a further arbitrariness of ratio.

In various countries the standard photo sizes have whole-number values in inches. This results in the following conversion:

size 4×6″=10.16×15.24 cm;

size 5×7″=12.7×17.78 cm;

size 8×10″=20.32×25.4 cm.

It can be seen here that the lengths (underlined), and thus their mutual ratios, i.e. the ratio of each length to the next larger length, approximate the standard metric sizes of 10×15; 13×20, and 18×25 cm.

The problem indicated above was solved in the present invention in that the mutual ratio(s) of the side lengths of different sizes, each dimensioned for a different one of the standard photo sizes of 9×13–10×15–13×20–18×25 cm and 4×6–5×7–8×10″, differ(s) from the mutual ratio(s) of the lengths of the corresponding standard photos by an amount such that for each of the mounts there is an equally large whole-number division value X (module) contained in their side lengths; in that the value of each mutual separating distance from center to center of a plurality per mount side of successively positioned click-in attachment fixtures contains the distribution value in whole-number fashion; and in that the specified ratio differences of the variously large mounts are equalized by dimensioning the widths of the frame element crossbars surrounding the window, or the widths of the picture rims covered by the frame elements, so as to accommodate this difference.

These measures achieved what appeared to be logically impossible: namely joining the different mount sizes, despite the differences in the mutual ratios of the corresponding standard photo sizes, into a common system of combinations—a system that additionally has the advantage of permitting the axially displaced mounting of equal and unequal mount sizes.

This principle of combination will be explained in detail below on the basis of the enclosed figures.

A further invention complex which also relates to a multiple picture-holder of the type defined above and which is also of significance rests in the fact that the click-in attachment fixtures on the backplates have a functionally symmetrical design with respect to the two directions determined by the side mount edges, such that the connecting clips furnished with matching fixtures can be successfully attached in either direction to the click-in attachment fixtures of the backplate.

This results in several unusual advantages.

The click-in attachment fixtures positioned in the mount corners are usable both for horizontal and for vertical mounting, thereby increasing the possibility of combinations. In addition, increased surface area is made available for the click-in attachment fixtures or for the catch devices of any click-in attachment fixture. This permits a relatively flat, elegant design, despite a soft but secure insertion. Unneeded spare clips can be placed out of sight behind the mounts and need not be stored elsewhere, running the risk of not be being found. As an alternative to cord-like hanging elements, the connecting clips can be positioned, when so desired, for use as suspension elements.

Further partly unusual invention features will be dealt with in detail below on the basis of the diagram discription.

The diagram shows invention embodiments. The figures show:

FIG. 1 front view of a single-frame mount dimensioned for a photo of standard size 9×13 cm, on a scale of 1:2

FIG. 2 backplate front-view of the mount shown in FIG. 1, on a scale of 1:1

FIG. 3 a portion of the back of the mount shown in FIG. 1, on a scale of 1:1

FIG. 4 side-view (photo insertion side) of the mount shown in FIG. 1, on a scale of 1:1

FIG. 5 the click-in fixture side of a connecting clip, on a scale of 1:1

Figure 6:
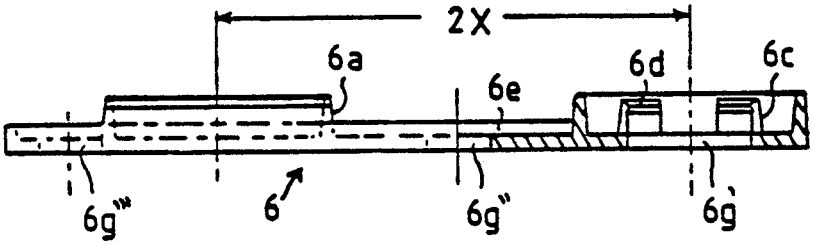
Figure 7:
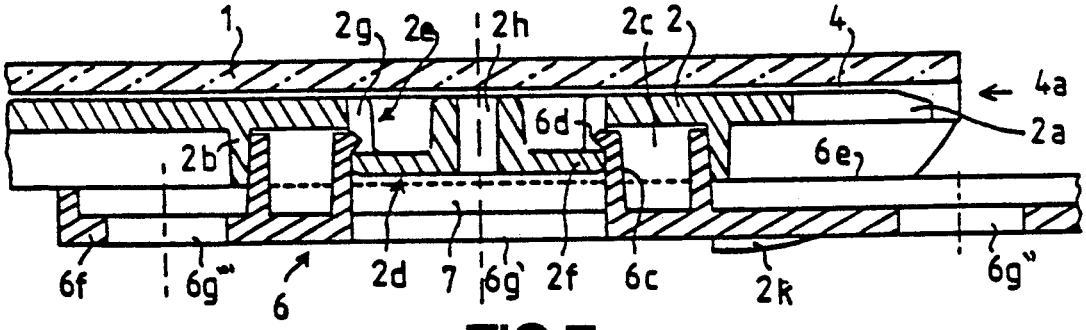

FIG. 6 a longitudinal view of the connecting clip shown in FIG. 5, showing section A—A FIG. 7 section B—B in FIG. 3, on a scale of 2:1

Figure 8:
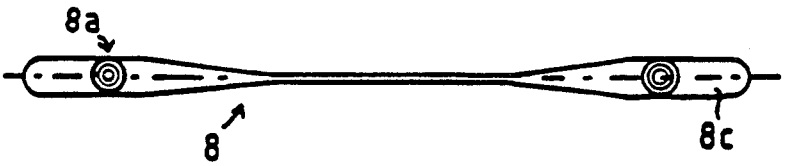

FIG. 8 a pin-tie in top-view, on a scale of 1:1

Figure 9:
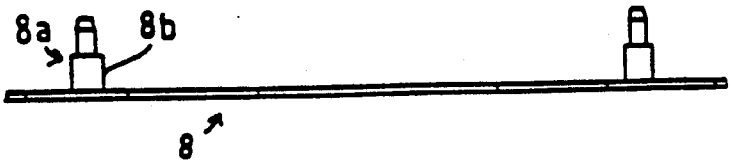

FIG. 9 a side view according to FIG. 8

Figure 10:
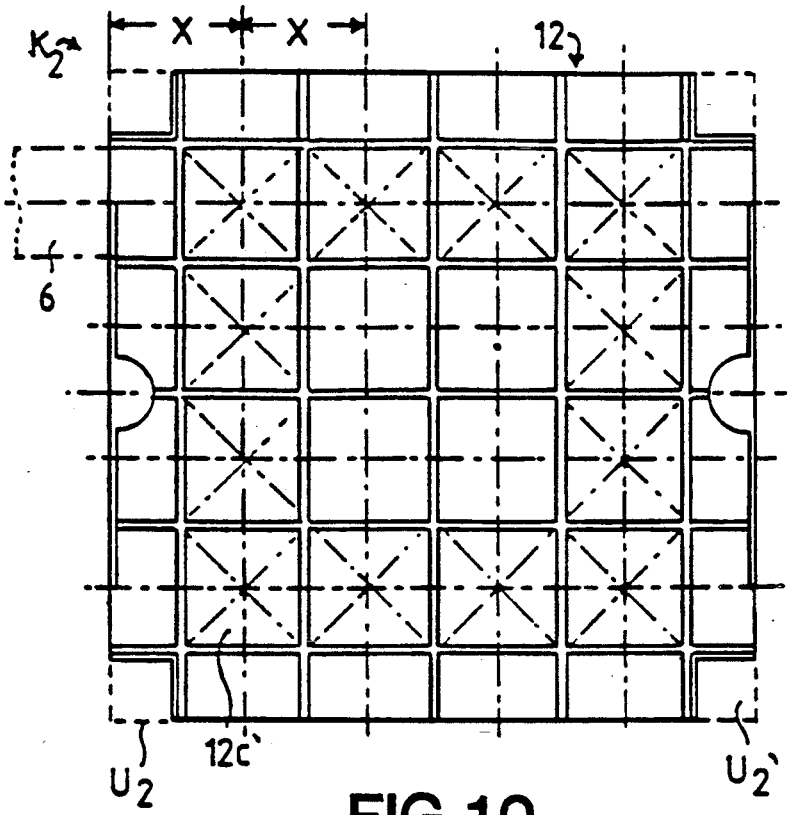

FIG. 10 back-view of a mount dimensioned for a photo of standard size 10×15 cm or 4×6″, on a scale of 1:2

Figure 11:
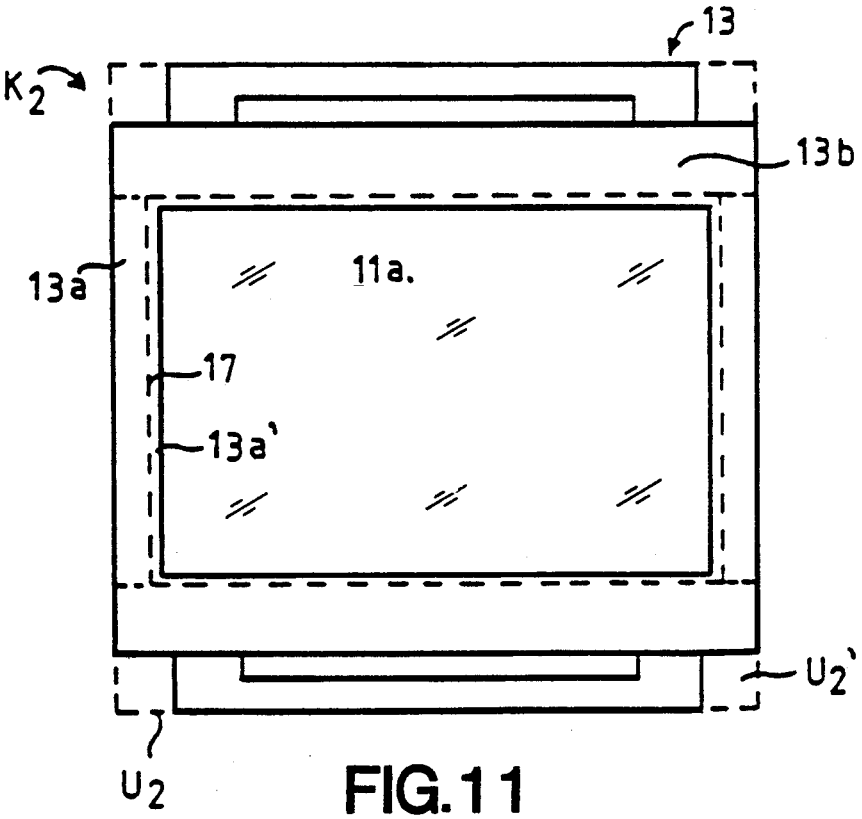

FIG. 11 front-view of the mount shown in FIG. 10

Figure 12:
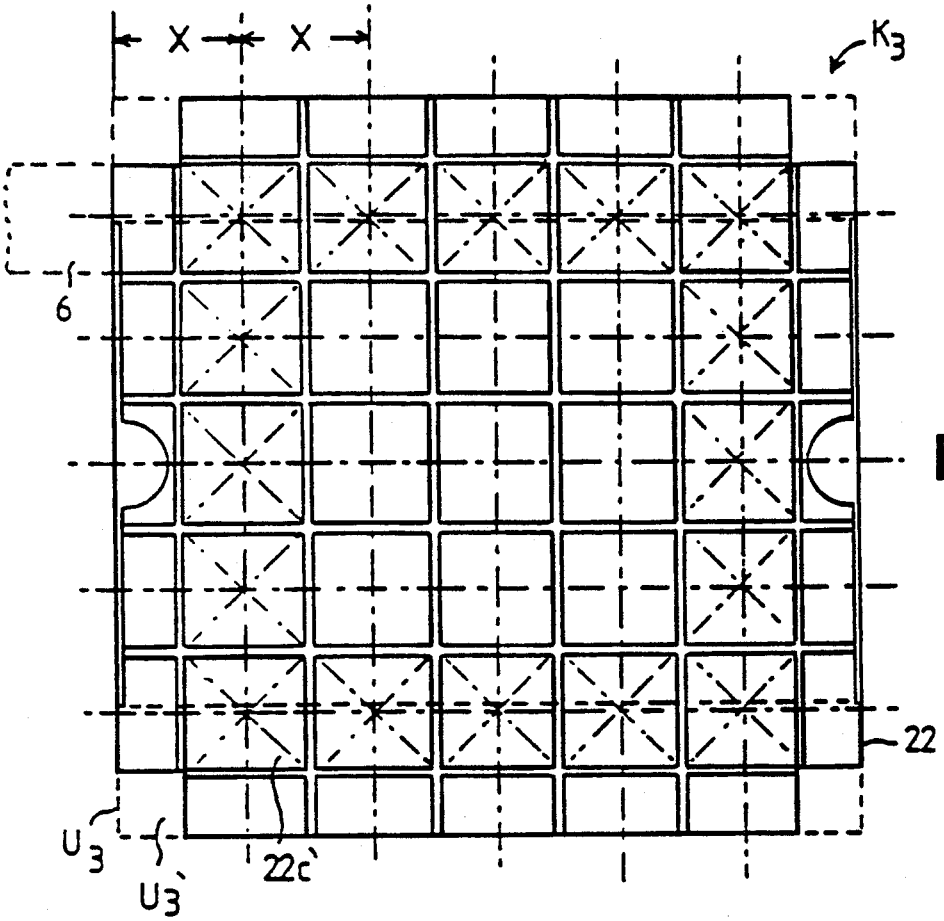

FIG. 12 back-view of a mount dimensioned for a photo of standard size 13×18 cm or 5×7″, on a scale of 1:2

Figure 13:
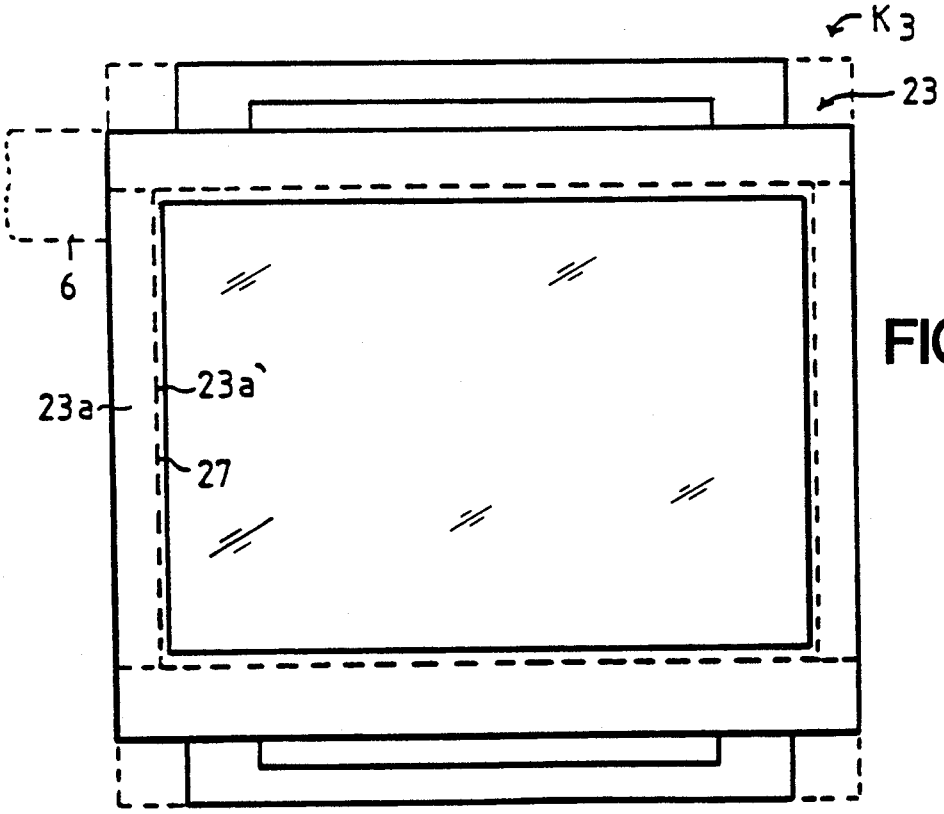

FIG. 13 front-view of the mount shown in FIG. 12

FIG. 14 back-view of a mount dimensioned for a photo of standard size 20×25 cm or 8×10″, on a scale of 1:2

FIG. 15 a portion of the mount shown in FIG. 14, in front-view

Figure 16:
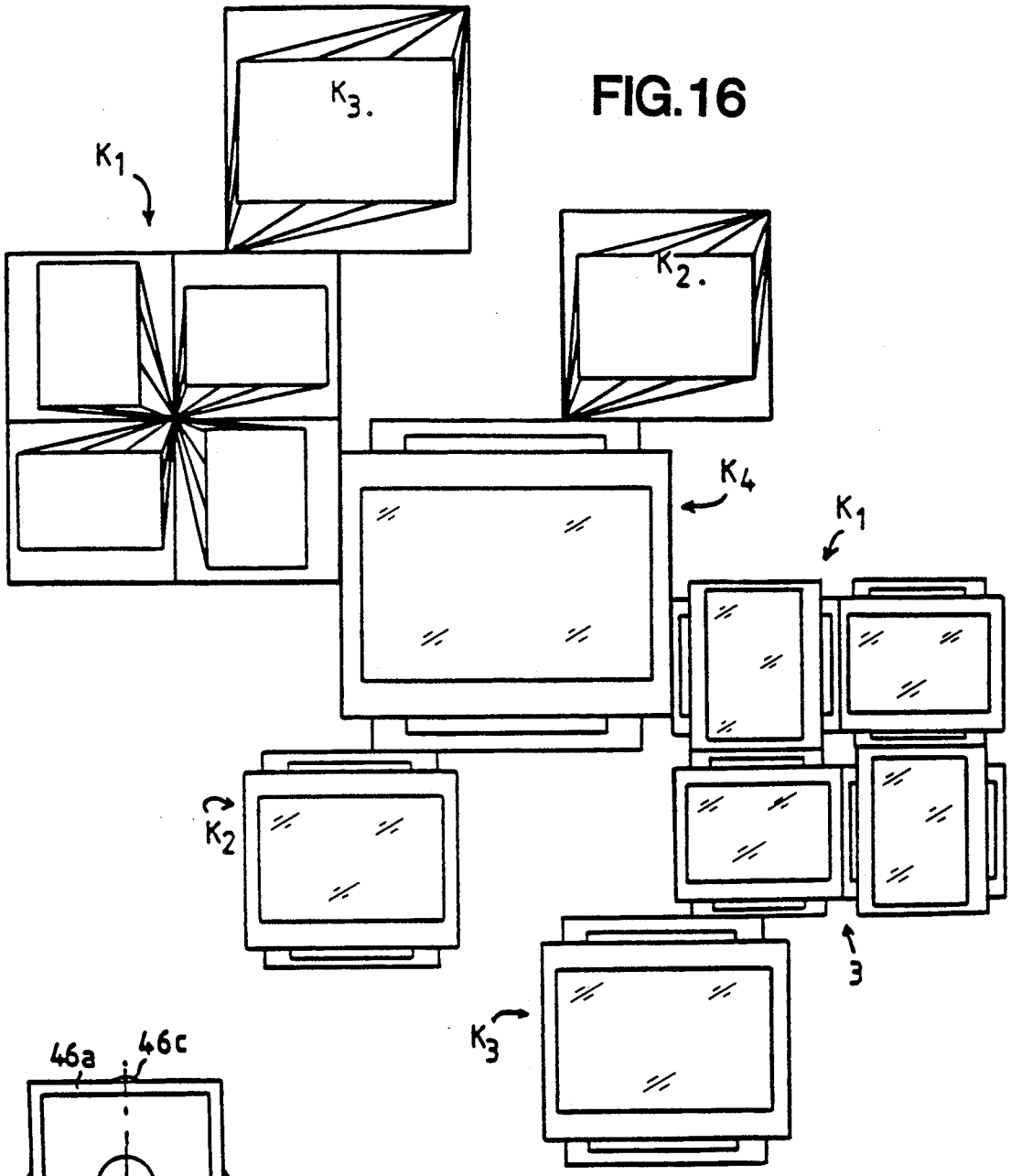

FIG. 16 front-view of a picture-holding combination consisting of four different mount sizes, on a scale of 1:5

Figure 17:
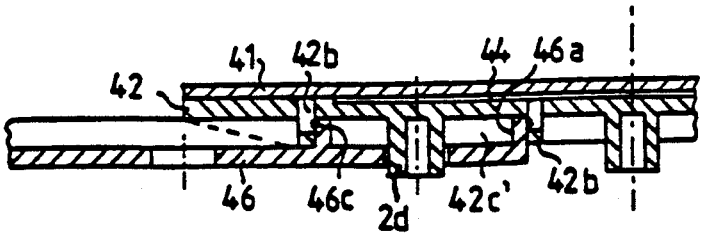

FIG. 17 a mount area section through a click-in attachment fixture provided with alternative click-in devices with a sectioned alternative connecting clip FIG. 18 partial length of the connecting clip shown in FIG. 10, view from below.

The mount $K^1$ shown in FIGS. 1 to 9 has a square shape $U^1$, which is reduced to a cross shape due to the recessed corner area $U^1$. The mount consists of the transparent faceplate 1 and the backplate 2, which are thus cross-shaped in form.

The faceplate 1 is covered by the mask 3, which has been pressed onto it and which surrounds the window 1*a*. Located behind the window 1*a*, i.e. between faceplate 1 and backplate 2, is the picture bed 4, which is molded to the backplate 2 in the form of a picture insert groove, with insert openings 4*a*. The backplate recesses 2*a* permit an inserted photo to be easily reached with a fingertip. Faceplate 1 and backplate 2 are attached to each other on lines 5 by means of ultrasound welding. The mount serves to receive a photo of standard size 9×13 cm, i.e. the picture bed 4 and the window 1*a* are dimensioned accordingly.

The backplate 2 is divided on its back by attached bridges 2*b* to form squares 2*c* of equal size; the outer squares serve as click-in attachment fixtures 2*c'* for connecting clips 6. Each pair of connecting clips have matching fixtures which are also formed by bridges and which interlock with the click-in attachment fixtures 2*c'* when the clip connection is made (FIGS. 3 and 7).

In its fixtures 2*c'* the backplate 2 centrally displays the attached hollow pins 2*d*, which are closed at the top; the side walls 2*e* of these pins have diametrically facing click-in recesses 2*g* below the face wall 2*f*. To match with these, the inside of the matching fixtures 6*b* of the connecting clips 6 are funished with diametrically opposed, self-supporting click-in tongues 6*c*, which lock inside the hollow pin front walls 2*f* within the click-in recesses 2*g* by means of projecting click-in catches 6*d*.

Between their matching fixtures 6*b* the connecting clips 6 are funished with stabilizing ribs 6*e* which run above the backplate bridges 2*b* when the clip connection has been made. The arrangement of the longitudinal ribs 6*e* and an appropriately small dimensioning of the hollow pins 2*d* permit the click-in tongues 6*c* to be long enough to assure a soft, but highly successful locking and unlocking effect. Unlocking occurs effortlessly thanks to the clip extension 6*f* applied to one side, and without auxiliary means. A second clip extension was omitted, since it is not necessary in and of itself and because it could prove to be a hindrance in creating certain combination of several mounts.

The connecting clip centrally displays hanging bores 6*g'*, 6*g''*, and 6*g''*,located within its matching fixture 6*b*, in the middle beween the latter, and in the extension 6*f*. Since is made there are several millimeters between the hollow pins 2*d* and the clip plane of open space 7 after the clip connection is made, each of these bores can be used for hanging if the need arises, i.e. they can be positioned on the head of nail or on a wall hook. If none of the hanging bores 6*g* to 6*g''* in the clip connections coincide with the line of gravity, another connecting clip 6 can be specially positioned to take over the suspension function (without in this case also serving to combine mounts).

As an alternative to this method of hanging the mounts, the hollow pins 2*d* of the backplate 2 can be provided with center insert holes 2*h*, for attachment with the pin tie 8 by means of the latter's elastic insert pin 8*a* (as a bridge between the adjacent mounts of a given combination). Due to the clip bores 6*g'*, 6*g''*, the pin tie 8 can also be inserted in insert holes 2*h* of those fixtures 2*c* that are occupied by a connecting clip 6. Due to the increased thickness of tie area 8*b*, an inserted tie pin 8 will rest above the clip plane.

FIGS. 3 and 4 also reveal that the rib areas 2*k* opening into the corner areas of backplate 2 are increased in height to form spacer feet that rest against the wall when the mount is hung.

As can also be seen from FIGS. 2 and 3, the four plate springs serving to secure the photo against faceplate 1 are attached to the backplate 2 in the corner areas of insert groove 4. They are concealed by the crossbars 3*a* of the mask. This assures that no pressure marks are visible on the front side of the inserted photo; nor can a frequent change of photos lead to visible scratches produced on thermoplastic faceplate by the photographic layer due to pressure.

As a result of the backplate design, single-frame mounts $K^1$ (of equal size) can be positioned against each other on all sides and can be attached by means of clips 6. Neighboring mounts $K^1$ can thus be selectively arranged in undisplaced or in staggered fashion. This permits the realization of various symmetrical or asymmetrical wall combinations, as dependent on the number of combined mounts $K^1$.

It was discovered that despite the basically divergent ratios among the lengths and widths of the various rectangular standard photo sizes, it is possible, with the acceptable modification of mask proportions or, as the case may be, the window proportions, to so adjust the mount dimensions, the given number of click-in attachment fixtures 2*c'*, the mean distance between click-in attachment fixtures 2*c'*, and the distances between the click-in attachment fixtures 2*c'* and the circumferential rims of the mounts, that mount sizes can be combined at will for various standard rectangular photo sizes.

This solution is based on a common value of division X determining all the above-specified parameters for differing mount dimensions.

The following possible X values were established, where the size and number of attachment fixtures differ: approx. 33.75 mm—approx. 27 mm—approx. 22.5 mm and approx. 16.875 mm.

A division value of 33.75 mm will be selected for the further explanation of the invention, as based on the figures already partially described and those yet to be described. This value is particularly favorable, since given a sufficient number of click-in attachment fixtures 2*c'* it results in relatively wide and long connecting clips 6, with a large degree of stability.

As seen in FIGS. 1 and 4, the square side length S of the square outline $U^1$ of mount $K^1$ for a 9×13 cm photo is $4X=4\times33.75=135$ mm). Both the separating distance between centerlines M of adjacent attachment fixtures 2*c'* and the separating distance between the mount sides and the centerlines M of the corresponding attachment fixtures 2*c'* parallel to these have the value X of 33.75 mm. The result is that each mount side in the present arrangement can be assigned a maximum of three click-in attachment fixtures 2*c'*. Remaining around the square surface area required overall by the attachment fixtures 2*c'* are the four marginal strips 2*m*, which have a width of X/2. They make it possible to position the indicated backplate recesses 2a permitting the picture to be changed and to position the springs covered by the mask 3. The size and form of the mask 3 can be harmoniously determined with respect to the dimensions of the photo (7-9×13 cm). In its longitudinal direction the photo 7 extends to (135−130/2=2.5 mm) and reaches the corresponding mount rims. Theoretically the two mask crossbars 3a thus need only be designed with a width of about 4 millimeter in order to achieve sufficient coverage of the photo rim 3a'. The crossbar width actually selected is therefore a first acceptable compromise for realizing the universal combining capability employing the various mount sizes with the division value of 33.75 mm by equalizing the crossbar widths of the various mount formats.

Mount $K^2$ according to FIGS. 10 and 11 is designed to receive photos of size 10×15 cm. The square outline $U^2$ has a side length of (5X=5×33.75=168.75 mm). Four attachment fixtures 12c' are assigned to the backplate 12 per mount side. In its longitudinal direction the photo reaches to (168.75−150/2=9/3 mm) and thus to the mount rims. In order to achieve a minimal rim coverage 13a' of the photo 17, the crossbars 13a of the mask 13 frame surrounding the window must be at least 10 mm wide.

The width of crossbar 3a of the 9×13 cm mount $K^1$ was thus enlarged in order to reduce the theoretical difference with mount $K^2$. Since the ratios for the mask crossbars 3b, 13b proceed in similar fashion, their modification need not be discussed here.

Mount $K^3$ according to FIGS. 12, 13 serves to receive photos of size 13×18 cm. The side lengths of the square outline $U^3$ is (6X=6×33.75=202.5 mm). This provides for a maximum of five click-in attachment fixtures 22c' per mount side. The photo extends in its longitudinal direction to 202.5−180/2=11.25 mm and reaches the mount rims. For minimum rim coverage 23a' this approximately corresponds to the necessary width of 12 mm for the crossbar 23a of mask 23. A crossbar width that agrees with the masks of mounts $K^1$ and $K^2$ can thus easily be established.

FIGS. 14 and 15 provide evidence that a mount $K^4$ for a photo of size 18×24/25 cm also fits into the invention's combining system. The square outline $U^4$ has a side length of 8X=8×33.75=270 mm). Since this is exactly twice the side length of $K^1$, special possibilities are available in this case. The maximum possible number of attachment fixtures 32c' assigned to the mount sides is seven. In its longitudinal direction a photo 37 of size 18×25 reaches to (270−250/2=10 mm) and to the mount rims. Here too the width of the crossbar 33a of mask 33 can be harmoniously adjusted to the masks of mounts $K^1$ to $K^3$ with sufficient coverage of the photo rim 33a and in such a way that the mount $K^4$ can also accommodate the standard metric photo size of 18×24.

In the following, evidence will be briefly presented to show that further division values of X can be applied and to reveal the advantages and disadvantages of these values relative to the already treated value of X=33.75.

Division value X of approximately 27 mm=33.75×8/10

Which provides the following values:

| | side length | max. attachment fixtures/side |
|---|---|---|
| $K^1$ (9 × 13 cm): | 5 × 27 = 135 mm | 4 |
| $K^2$ (10 × 15 cm): | 6 × 27 = 162 mm | 5 |
| $K^3$ (13 × 18 cm): | 7 × 27 = 189 mm | 6 |
| $K^4$ (18 × 25 cm): | 10 × 27 = 270 mm | 9 |

A centered photo thus displays the following rim separating distances in the longitudinal direction:

$$K^1=2.5\ mm,\ K^2=6\ mm,\ K^3=4.5\ mm,\ K^4=10\ mm$$

In the case of $K^1$ and $K^4$ the rim distances are thus identical to those of division value 33.75 mm. For $K^2$ the distance of 6 mm is more favorable than 9 mm, and for $K^3$ the value of 4.5 mm is less favorable than the comparable 11 mm. Advantages and disadvantages with respect to the modification of the masks thus balances each other out. The backplate outfittings are more expensive with a larger number of click-in attachment fixtures. Attachment fixtures and connecting clips are small, which decreases the combining stability accordingly.

Division value X of approximately 22.5 mm=33.75×2/3

Which provides the following values:

| | side length | max. attachment fixtures/side |
|---|---|---|
| $K^1$ (9 × 13 cm): | 6 × 22.5 = 135 mm | 5 |
| $K^2$ (10 × 15 cm): | 6 × 22.5 = 157.5 mm | 6 |
| $K^3$ (13 × 18 cm): | 7 × 22.5 = 202.5 mm | 8 |
| $K^4$ (18 × 25 cm): | 10 × 22.5 = 270 mm | 11 |

A centered photo thus displays the following rim separating distances in the longitudinal direction:

$$K^1=2.5\ mm,\ K^2=3.75\ mm,\ K^3=11.25\ mm,\ K^4=10\ mm$$

These rim distances for the mask dimensions are more favorable than the division value of 33.75 for $K^2$ particularly: 3.75 mm instead of 9 mm. Less favorable, however, in terms of cost is the much large number of click-in attachment fixtures. In adition, the connecting clips are very small, which necessitates a larger number of clips in achieving the needed stability.

Division value X of approximately 16.875 mm=33.75/2

Which provides the following values:

| | side length | max. attachment fixtures/side |
|---|---|---|
| $K^1$ (9 × 13 cm): | 6 × 16.875 = 135 mm | 7 |
| $K^2$ (10 × 15 cm): | 6 × 16.875 = 168.75 mm | 9 |
| $K^3$ (13 × 18 cm): | 7 × 16.875 = 202.5 mm | 11 |
| $K^4$ (18 × 25 cm): | 10 × 16.875 = 270 mm | 15 |

A centered photo thus displays rim separating distances for all mount sizes that are equal to those for division value 33.75. Thus the same conditions for the mask dimension apply. The click-in attachment fixtures and connecting clips are usually small, however, with the result that either a greater number of connecting clips must be employed or the clips must be designed as double axes which interlock at each end with two click-in attachment fixtures. All of this makes the use of this division value very expensive in terms of outfittings.

With the combining system under the invention and with its four division values a further advantage of considerable signification is afforded, in that the standard photo sizes in inches 4×6", 5×7", and 8×10" are accommodated simultaneously. These sizes have the following metric dimensions:

10.16×15.24 cm 12.7×17.8 cm 20.3×25.4 cm

The lengths 15.24 cm, 17.8 cm, and 25.4 cm thus vary only insignificantly from the lengths 15.0 cm, 18.0, and 25.0 of the metric sizes 10×13, 13×18, and 18×25, and thus all side lengths of mounts $K^2$, $K^3$, and $K^4$ established by means of the different division values do justice to the above-indicated sizes in inches.

The above-indicated division values X of approximately 33.75 mm, 27 mm, 22.5 mm, and 168.75 mm represent favorable values, particularly for compensating mask dimensions. The framework of the invention would not be abandoned by varying the division values by up to ±3.5%, while tolerating the proportionately greater deviations in the dimensions of the mask cross-bar widths and the covering widths of the picture rims. With −3.5% the side length of the square is shortened to about the length of the photo, whichever mount size is employed.

For all mount sizes $K^1$ to $K^4$, the click-in attachment fixtures 2c' are surrounded on all sides by a continuous strip (designated 2m in the case of mount $K^1$) of X/2. By omitting the finger recesses and the spring 2n indicated only for mount $K^1$ it would naturally be possible to move the click-in attachment fixtures outward to the circumferential rims. This would permit each mount side e.g. of $K^1$ to be assigned four attachment fixtures instead of three. For reasons of division in that case it would be necessary either to omit the bridges 2b coinciding with the outer edges or cut the thickness in half. The free strips are thus extremely advantageous.

By the same token, it is conceivable that the width of the rim strips 2m could be enlarged up to the division value X, which would result in the elimination of one attachment fixture 2c' per mount side. However, this would impose a considerable restriction on the system's combining capacity in the case of mount $K^1$ and the division value of 33.75.

With the corner recesses $U^{1'}$ to $U^{4'}$, i.e. the cross-shaped formation of mounts $K^1$ to $K^4$, which are themselves square, the latter are de-emphasized with respect to their rectangular window. The result is that mask 3 optically has the appearance of two intersecting rectangles, of which the right rectangle with the window interrupts the other. Naturally these corner recesses are not mandatory and can be omitted, particularly when loose design effects are to be created through the appropriate combination of masks.

In the combination shown in FIG. 16 the cross-shaped formation is omitted in the case of upper mounts $K^1$ to $K^3$.

The figural descriptions clearly reveal various advantages in addition to those of the module system. The click-in attachment fixtures 2c' can function in two directions. As a result the fixtures 2c can be used in the corner areas both for horizontal and vertical mounting. Unused clips 6 can be concealed longitudinally or diagonally behind the backplate 2. As a function of the line of gravity of a given combination, the pin tie 8 can be reinserted as desired: in two adjacent click-in attachment fixtures, from one attachment fixture into the next one, and as a bridge from mount to neighboring mount. The click-in attachment fixtures and their insertion devices are broad in area and, with a soft but secure fitting, permit a correspondingly flat construction.

Figure 18:
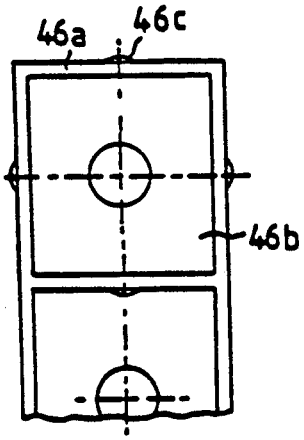

FIGS. 17 and 18 show that the needed insertion devices can also be provided for the bridges 42b which form the click-in attachment fixtures 42c' of backplate 42 and the matching fixtures 46b of clips 46. The backplate bridges 42b have click-in recesses 42b', which engage the click-in projections 46c of the clip ribs 46a. The faceplate is designated 41 and the picture bed 44. This type of connection is difficult to manipulate, however, unless the bridges 46a are slotted next to the projections 46c, which would result in spring-like tongues.

As an alternative to ultrasound welding, the faceplate and backplate could be attached in facing fashion by means of clamps which overlap their rims. However, the square outline would then be determined by the outer edges of the clamps. Likewise, the faceplates could overlap the backplates with recessed rim areas in locking fashion. Larger sized combinations would not be stable, however.

I claim:

1. A picture frame for receiving pictures or photographs adapted for attaching to at least one other said picture frame by means of connecting clips, said picture frame comprising a front plate and a back plate for holding a picture therebetween, said back plate comprising a plurality of adjacent click-in fixtures on a reverse side thereof, and at least one connecting clip for joining click-in fixtures of adjacent picture frames;

wherein a plurality of said click-in fixtures are arranged adjacent to each other in series on said back plate and centers of all adjacent click-in fixtures are separated by a distance X, wherein X is divisible into the length of a photograph frame size to give approximately a whole number quotient;

said at least one connecting clip comprises first and second click-in catches each click-in catch being separated from each other click-in-catch by a distance 2X, each said click-in catch being adapted for engaging a click-in fixture of first and second picture frames respectively, for joining said first and second picture frames together;

wherein centers of said click-in fixtures are spaced from a side edge of said back plate by a distance 0.5 nX, where n is an integer; and wherein said click-in fixtures and click-in catches are functionally symmetrical wherein a connecting clip may be attached to a click-in fixture in one or more directions depending on the spacing from a side edge, for attaching picture frames together.

2. A picture frame according to claim 1 wherein said click-in fixtures and connecting clips are adapted for connecting said first picture frame to said second picture frame disposed with a side thereof adjacent any side of said first picture frame.

3. A picture frame according to claim 2 wherein said click-in fixtures are separated from a side edge of said back plate by a distance of 0.5 X.

4. A picture frame according to claim 3 wherein said bridging elements engage with corresponding elements molded in a connecting clip.

5. A picture frame according to claim 1 wherein a plurality of said click-in fixtures are disposed adjacent each other parallel to edges of said frame.

6. A picture frame according to claim 1 comprising bridging elements molded in said back plate forming a grid-like arrangement between said click-in fixtures.

7. A picture frame according to claim 1 wherein said click-in fixtures are symmetrically shaped.

8. A picture frame according to claim 1 wherein each said click-in fixture on said picture frame comprises an upstanding portion having a substantially circular perimeter and including recesses disposed around said perimeter.

9. A picture frame according to claim 1 wherein each said click-in catch on a connecting clip comprises a portion having a substantially circular perimeter and including said projecting click-in catches disposed around said perimeter.

10. A picture frame according to claim 1 wherein each said click-in fixture comprises means for engaging a hanger for said picture frame.

11. A picture frame according to claim 10 further comprising a hanger having a pair of ends for engaging click-in fixtures in said back plate and a connecting portion between said ends.

12. A picture frame according to claim 10 wherein said ends each frictionally engage an aperture in a click-in fixture in said back plate.

13. A picture frame according to claim 1 wherein said picture frame is substantially rectangular in shape.

14. A picture frame according to claim 1 wherein said picture frame is substantially square in shape.

15. A picture frame according to claim 1 wherein a connecting clip is adapted for engaging two click-in fixtures on a single picture frame for transportation of the picture frame.

16. A picture frame according to claim 1 wherein X is between about 32.5 and 34.9 mm and is preferably about 33.75 mm.

17. A picture frame according to claim 1 wherein X is between about 26 and 28 mm and is preferably about 27 mm.

18. A picture frame according to claim 1 wherein X is between about 21.7 and 23.3 mm and is preferably about 22.5 mm.

19. A picture frame for receiving pictures or photographs adapted for attaching to at least one other said picture frame by means of connecting clips, said picture frame comprising a front plate and a back plate for holding a picture therebetween, said back plate comprising a plurality of adjacent click-in fixtures on a reverse side thereof; and at least one connecting clip for joining click-in fixtures of adjacent picture frames;

wherein each said click-in fixture comprises a plurality of recesses for receiving corresponding projecting click-in catches of a corresponding click-in fixture on a connecting clip;

wherein a plurality of said click-in fixtures are arranged adjacent to each other in series on said back plate and centers of all adjacent click-in fixtures are separated by a distance of X; said connecting clip comprises first and second click-in catches, each click-in catch being separated from each other click-in catch by a distance of 2X, each said click-in catch being adapted for engaging a click-in fixture of first and second picture frames respectively, for joining said first and second picture frames together;

wherein centers of said click-in fixtures are spaced from a side edge of said back plate by a distance of 0.5 nX, where n is an integer; and wherein said click-in fixtures and click-in catches are functionally symmetrical wherein a connecting clip may be attached to a click-in fixture in one or more directions depending on the spacing from a side edge, for attaching picture frames together.

20. A picture frame for receiving pictures or photographs adapted for attaching to at least one other said picture frame by means of connecting clips, said picture frame comprising a front plate and a back plate for holding a picture therebetween, said back plate comprising a plurality of adjacent click-in fixtures on a reverse side thereof, each fixture adapted for receiving a connecting clip;

wherein bridging elements molded in said back plate form a grid-like arrangement between said click-in fixtures, and said click-in fixtures are functionally symmetrical wherein a connecting clip may be attached to a click-in fixture in one or more directions depending on the spacing from a side edge, for attaching picture frames together; and wherein a plurality of said click-in fixtures are arranged adjacent to each other in series on said back plate and centers of all adjacent click-in fixtures are separated by a distance X, wherein X is divisible into the length of a photograph frame size to give approximately a whole number quotient.

21. A picture frame for receiving pictures or photographs adapted for attaching to at least one other said picture frame by means of connecting clips, said picture frame comprising a front plate and a back plate for holding a picture therebetween, said back plate comprising a plurality of adjacent click-in fixtures on a reverse side thereof;

wherein a plurality of said click-in fixtures are arranged adjacent to each other in series on said back plate and centers of all adjacent click-in fixtures are separated by a distance X, wherein X is divisible into the length of a photograph frame size to give approximately a whole number quotient;

wherein centers of said click-in fixtures are spaced from a side edge of said back plate by a distance 0.5 nX, where n is an integer; and wherein said picture frame further comprises a hanger and said click-in fixtures each comprise means for engaging a hanger for said picture frame, centers of adjacent means for engaging a hanger being separated by a distance X, and wherein the hanger comprises a pair of ends for engaging said click-in fixtures and a flexible connecting portion extending between said ends, said connecting portion having a length of at least 2X.

22. A picture frame according to claim 21 wherein said means for engaging a hanger comprises a recess in a central portion of a click-in fixture.

* * * * *

UNITED STATES PATENT AND TRADEMARK OFFICE

CERTIFICATE OF CORRECTION

PATENT NO. : 5,267,403

DATED : December 7, 1993

INVENTOR(S) : Walter Hesener

It is certified that error appears in the above-indentified patent and that said Letters Patent is hereby corrected as shown below:

On title page, item [19] "Hesner" should read --Hesener--.

On title page, item [76] should read as follows:

--Walter Hesener--.

Signed and Sealed this

Sixteenth Day of August, 1994

*Attest:*

Bruce Lehman

BRUCE LEHMAN

*Attesting Officer*

*Commissioner of Patents and Trademarks*